US010946669B2

(12) United States Patent
Mizutani et al.

(10) Patent No.: US 10,946,669 B2
(45) Date of Patent: Mar. 16, 2021

(54) INKJET RECORDING APPARATUS, INKJET RECORDING METHOD, AND INKJET RECORDING PROGRAM

(71) Applicant: KONICA MINOLTA, INC., Tokyo (JP)

(72) Inventors: Toshiyuki Mizutani, Hino (JP); Yorihiro Yamaya, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/740,688

(22) Filed: Jan. 13, 2020

(65) Prior Publication Data

US 2020/0254780 A1 Aug. 13, 2020

(30) Foreign Application Priority Data

Feb. 12, 2019 (JP) ..... JP2019-023079

(51) Int. Cl.
*B41J 2/21* (2006.01)

(52) U.S. Cl.
CPC ..... *B41J 2/2135* (2013.01)

(58) Field of Classification Search
CPC ..... B41J 2/2135; B41J 2/2146; G06K 15/107
See application file for complete search history.

(56) References Cited

U.S. PATENT DOCUMENTS

2018/0257376 A1* 9/2018 Mizutani ..... B41J 2/04581

FOREIGN PATENT DOCUMENTS

| | | |
|---|---|---|
| JP | 2005306014 A | 11/2005 |
| JP | 2011116096 A | 6/2011 |
| JP | 2014195896 A | 10/2014 |

* cited by examiner

*Primary Examiner* — Bradley W Thies
(74) *Attorney, Agent, or Firm* — Buchanan Ingersoll & Rooney PC

(57) ABSTRACT

An inkjet recording apparatus includes: a recorder having a line head, the recorder ejecting ink through each of the ink ejection ports toward a recording medium; a mover that moves the recording medium and the line head relative to each other in a direction intersecting the arrangement direction of the ink ejection ports in the line head, and causes each pair of ink ejection ports of two adjacent head modules facing each other in the overlapping region to pass through a same place on the recording medium; and a recording controller that controls ink ejection operations of the plurality of head modules on the recording medium in accordance with dot data, and causes either of a pair of ink ejection ports of two adjacent head modules to eject ink to implement complementary ink ejection operations by the pair of ink ejection ports of the two head modules.

20 Claims, 17 Drawing Sheets

INKJET RECORDING APPARATUS, INKJET RECORDING METHOD, AND INKJET RECORDING PROGRAM

The entire disclosure of Japanese patent Application No. 2019-023079, filed on Feb. 12, 2019, is incorporated herein by reference in its entirety.

BACKGROUND

Technological Field

The present invention relates to an inkjet recording apparatus, an inkjet recording method, and an inkjet recording program, and more particularly to a single pass inkjet recording apparatus that prevents image quality deterioration in an overlapping region (joint) of head modules, and to an inkjet recording method and an inkjet recording program therefor.

Description of the Related Art

An inkjet recording apparatus that forms an image by ejecting ink droplets from inkjet heads to a recording medium has a simpler structure and is easier to reduce in size and weight than an electrophotographic system. It does not require a heat fixer unlike an electrophotographic system, and consumes relatively low energy. Thus, inkjet recording apparatuses have been widely used in recent years.

What is called a single pass inkjet recording apparatus uses, as an inkjet head, a line head including a staggered array of short head modules overlapping in an overlapping region. Such an inkjet recording apparatus is problematic because image quality deteriorates in an overlapping region (joint) of head modules.

In order to prevent image quality deterioration in an overlapping region of head modules in a single pass inkjet recording apparatus, JP 2005-306014 A discloses that, in an overlapping region, ink ejection ports are arranged without overlapping in the conveying direction of a recording medium, and the time difference between ink landings on partially overlapping dots is kept constant.

The inkjet recording apparatus described in JP 2014-195896 A has an overlapping region with a lower ejection rate and a higher recording duty than a non-overlapping region.

In an overlapping region of the inkjet recording apparatus described in JP 2011-116096 A, the end of a head module has a smaller dot recording density and a smaller number of sequential dots than the middle part of the overlapping region.

In a single pass inkjet recording apparatus, if the time difference between ink landings on partially overlapping dots or dots that are connected after ink landing is large in an overlapping region, the dots in the overlapping region differ in image quality, e.g. gloss, from dots formed similarly in a non-overlapping region.

As illustrated in FIG. 16, the time difference between ink landings on two dots of the same color in an overlapping region is 25 msec, for example, when the ink droplets are ejected from the same head module (HM), and is 100 msec, for example, when the ink droplets are ejected from different head modules.

Referring now to FIGS. 17A to 17D. FIG. 17A depicts the height shape of dots connected after ink landing in an overlapping region (landing time difference: 100 msec), and FIG. 17B depicts the height shape of dots connected after ink landing in a non-overlapping region (landing time difference: 25 msec). The difference between these shapes causes a difference in how surface reflected light is scattered, resulting in a difference in gloss. FIG. 17C depicts the height shape of dots that are not connected after ink landing in an overlapping region (landing time difference: 100 msec), and FIG. 17D depicts the height shape of dots that are not connected after ink landing in a non-overlapping region (landing time difference: 25 msec). These shapes do not differ, causing no difference in gloss.

FIG. 18 depicts surface shapes of sequential dots in a non-overlapping region (landing time difference: 25 msec) and an overlapping region (landing time difference: 100 msec) which vary according to the medium temperature at the time of ink landing. The surface shapes also differ between the non-overlapping region (landing time difference: 25 msec) and the overlapping region (landing time difference: 100 msec), resulting in a difference in gloss.

This is because the phase change of ink proceeds during the time between 25 msec and 100 msec after ink landing on the recording medium. Specifically, the state of ink fusion varies between a dot that overlaps or connects to another dot immediately after ink landing without undergoing a phase change and a dot that undergoes a phase change after ink landing and then overlaps or connects to another dot. Therefore, the height shapes of the dots differ, resulting in a difference in gloss.

The difference in image quality as illustrated in FIGS. 17A and 17B and FIG. 18 is particularly noticeable when using an ink that undergoes a state change after ink landing, such as phase change ink. However, even when phase change ink is not used, the state of reaction between ink and pretreatment material and the state of infiltration into the recording medium vary between a dot that overlaps or connects to another dot immediately after ink landing and a dot that overlaps or connects to another dot some time after ink landing, resulting in a difference in texture. Such problems are not described in any of JP 2005-306014 A, JP 2014-195896 A, and JP 2011-116096 A.

SUMMARY

Thus, an object of the present invention is to provide a single pass inkjet recording apparatus that prevents image quality deterioration in an overlapping region (joint) of head modules, and an inkjet recording method and an inkjet recording program therefor.

Other objects of the present invention will become apparent from the following description.

To achieve at least one of the abovementioned objects, according to an aspect of the present invention, an inkjet recording apparatus reflecting one aspect of the present invention comprises: a recorder having a line head, the line head including a plurality of head modules each having a plurality of ink ejection ports arranged in a line, the head modules being arranged in an arrangement direction of the ink ejection ports and overlapping in an overlapping region, the recorder ejecting ink through each of the ink ejection ports toward a recording medium; a mover that moves the recording medium and the line head relative to each other in a direction intersecting the arrangement direction of the ink ejection ports in the line head, and causes each pair of ink ejection ports of two adjacent head modules facing each other in the overlapping region to pass through a same place on the recording medium; and a recording controller that controls ink ejection operations of the plurality of head modules on the recording medium in accordance with dot data that are based on image data, and causes, in the overlapping region, either of a pair of ink ejection ports of two adjacent head modules to eject ink to implement complementary ink ejection operations by the pair of ink ejection ports of the two head modules, wherein in the overlapping region, the recording controller switches from ink ejection from one of a pair of ink ejection ports to ink ejection from the other ink ejection port when at least one condition is satisfied, and the one condition is that a non-ejection section has continued for a predetermined length or more in the dot data.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, an inkjet recording apparatus according to one or more embodiments of the present invention will be described with reference to the drawings. However, the scope of the invention is not limited to the disclosed embodiments. An inkjet recording method according to an embodiment of the present invention is embodied as the operation of the inkjet recording apparatus, and is implemented by the inkjet recording apparatus executing an inkjet recording program according to an embodiment of the present invention. However, the scope of the invention is not limited to the illustrated examples. In the following description, components having the same functions and configurations are denoted by the same reference signs, and descriptions thereof may be omitted.

First Embodiment

Figure 1:
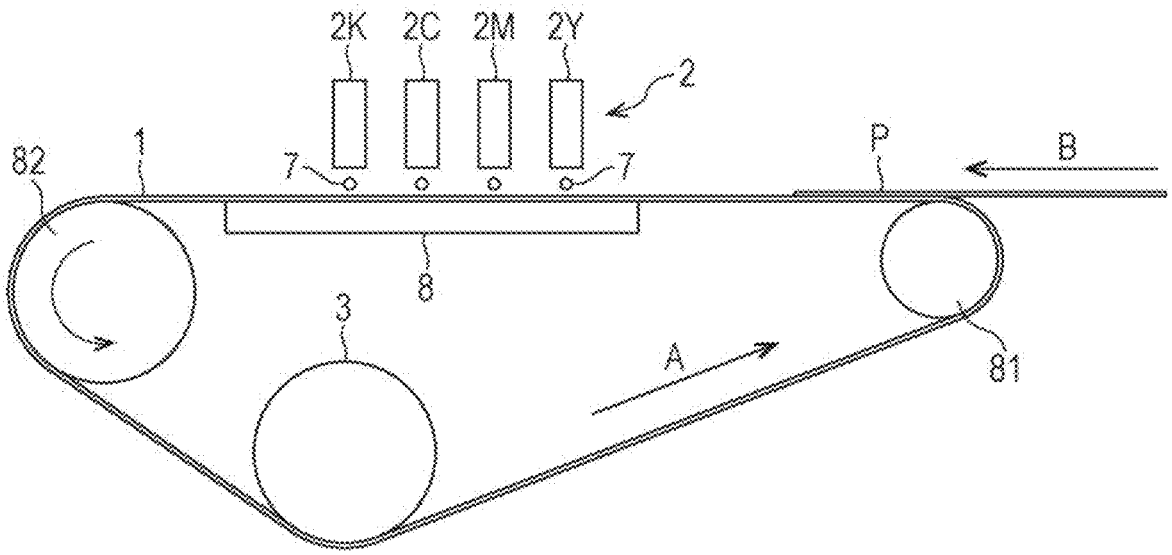
FIG. 1 is a schematic diagram illustrating an inkjet recording apparatus according to a first embodiment.

FIG. 1 is a schematic diagram illustrating an inkjet recording apparatus according to the first embodiment.

As illustrated in FIG. 1, the inkjet recording apparatus has an endless belt-shaped conveying belt 1 stretched between rollers 81 and 82, and includes a mover that conveys a recording medium P with the conveying belt 1.

The inkjet recording apparatus also includes a recorder having an inkjet head 2Y for yellow ink, an inkjet head 2M for magenta ink, an inkjet head 2C for cyan ink, and an inkjet head 2K for black ink (hereinafter also collectively referred to as the "inkjet heads 2") that eject ink 7 based on image data and form an ink image on the surface of the recording medium P. Note that the number of inkjet heads and the number of colors are not limited at all.

As indicated by arrow A, the conveying belt 1 is fed between the rollers 81 and 82 and a tension roller 3. The conveying belt 1 moves the recording medium P placed on the outer surface thereof relative to the inkjet heads 2 as indicated by arrow B. An attracting plate 8 is placed on the inner surface of the conveying belt 1 at a position facing the inkjet heads 2. The attracting plate 8 attracts the recording medium P and the conveying belt 1 and brings the recording medium P and the conveying belt 1 into close contact with each other. The recording medium P is in close contact with the conveying belt 1 and supported by the attracting plate 8 so as to be kept flat while moving with respect to the inkjet heads 2. Note that the attracting plate 8 need not be provided if it is not necessary to keep the recording medium P flat.

In this embodiment, the inkjet heads 2 and the recording medium P are moved relative to each other by the feeding operation of the conveying belt 1, but the inkjet heads 2 may be operated to move relative to the recording medium P.

In this inkjet recording apparatus, the ink 7 is ejected from the inkjet heads 2 based on image data, and an ink image is formed on the surface of the recording medium P. The inkjet heads 2 can be implemented using a conventionally known method such as an on-demand method or a continuous method. Ejection can be performed using, for example, an electro-mechanical conversion method such as single cavity, double cavity, bender, piston, shear mode, or shared wall, an electric-heat conversion method such as thermal inkjet or bubble jet (registered trademark), or an electrostatic absorption method such as spark jet.

The ink 7 for the inkjet recording apparatus is a liquid medium including dispersed pigments, and may contain a conventionally known additive such as a surfactant or a dispersant as necessary. The liquid medium may be either an aqueous medium or an oily medium.

Phase change inks and ultraviolet (UV) curable inks are also preferable. A phase change ink undergoes a phase change and thickens according to the temperature of the recording medium P after being landed on the recording medium P. Furthermore, it is also possible to use a two-component reactive ink that undergoes a phase change by reacting with a pretreatment material applied onto the recording medium P.

Pigments may be color materials or microcapsules containing color materials. The particle size of pigments is preferably in the range of 50 nm to 200 nm, for example. The pigment content in the ink is, for example, preferably in the range of 0.1% by mass to 15% by mass, and more preferably in the range of 0.5% by mass to 12% by mass.

Figure 2:
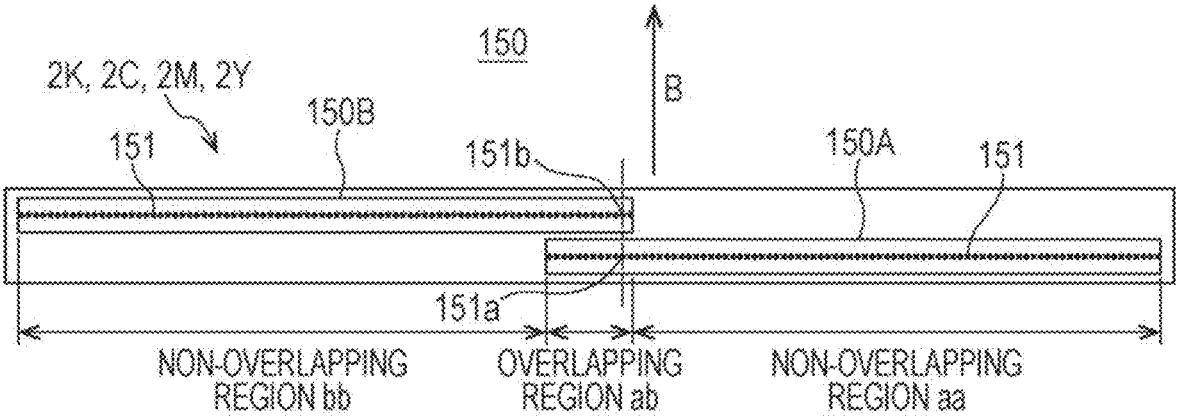
FIG. 2 is a schematic diagram illustrating the main part of a line head of the inkjet recording apparatus according to the first embodiment.

FIG. 2 is a schematic diagram illustrating the main part of a line head of the inkjet recording apparatus according to the first embodiment.

Figure 16:
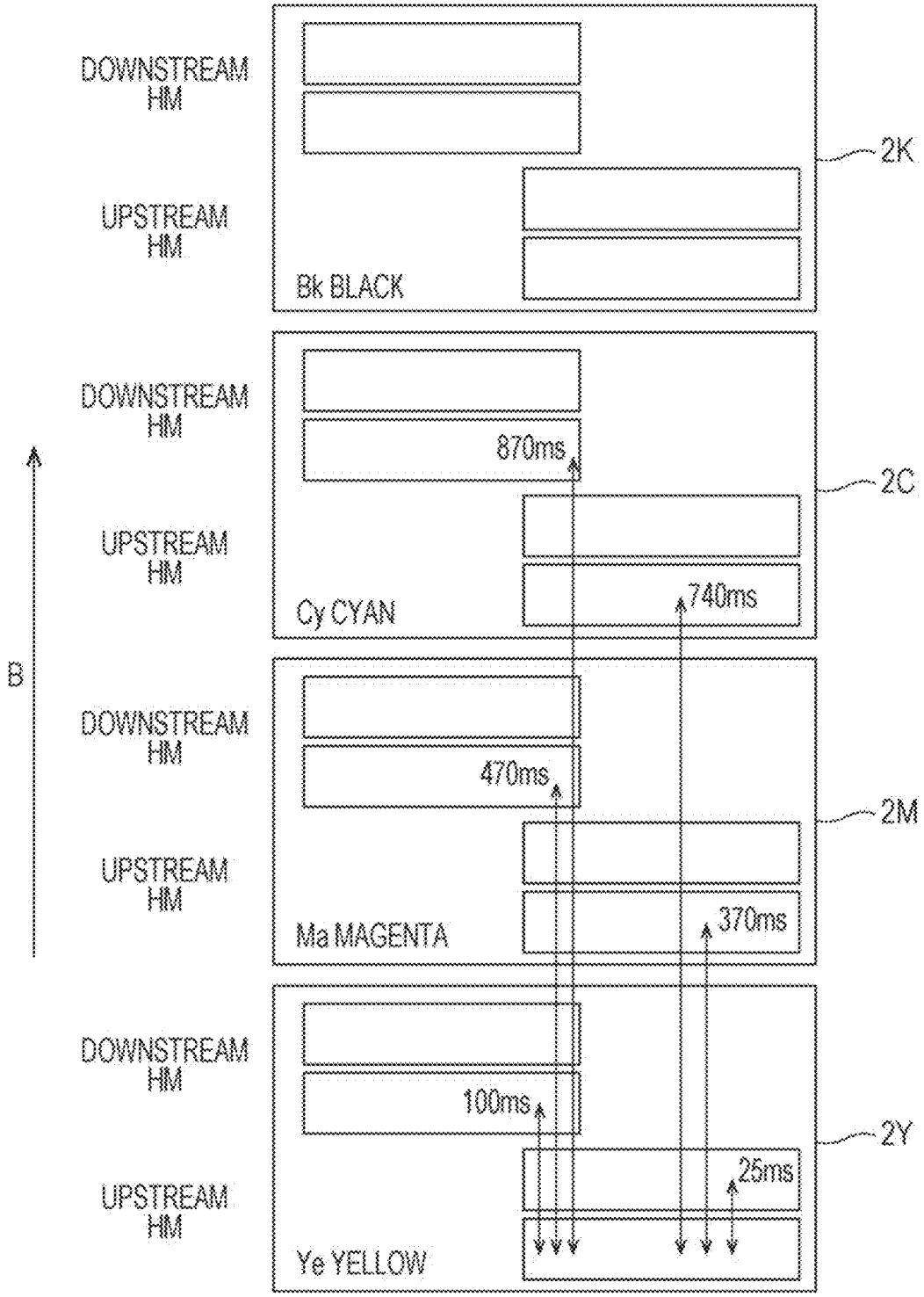
FIG. 16 is a plan view illustrating time differences between ink landings on two dots in an overlapping region and a non-overlapping region.
Figure 17A:
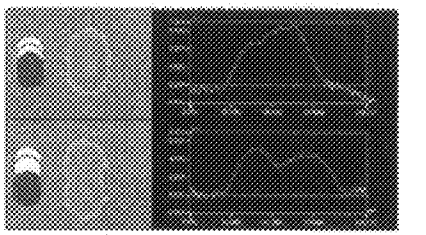
FIG. 17A is a graph illustrating the height shape of dots connected after ink landing in an overlapping region (landing time difference: 100 msec)
Figure 17B:
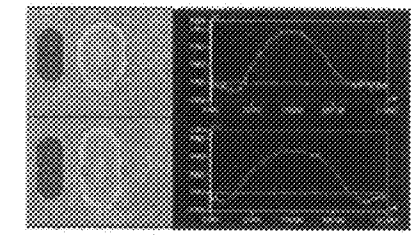
FIG. 17B is a graph illustrating the height shape of dots connected after ink landing in a non-overlapping region (landing time difference: 25 msec)
Figure 17C:
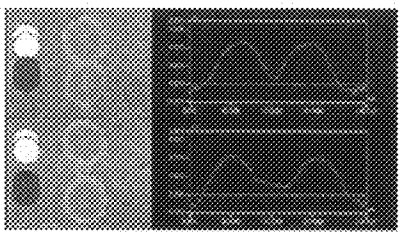
FIG. 17C is a graph illustrating the height shape of dots that are not connected after ink landing in an overlapping region (landing time difference: 100 msec)
Figure 17D:
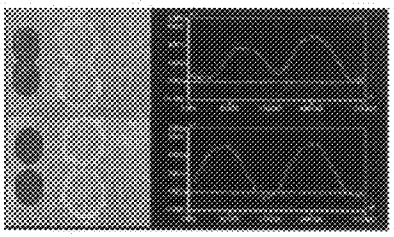
FIG. 17D is a graph illustrating the height shape of dots that are not connected after ink landing in a non-overlapping region (landing time difference: 25 msec)
Figure 18:
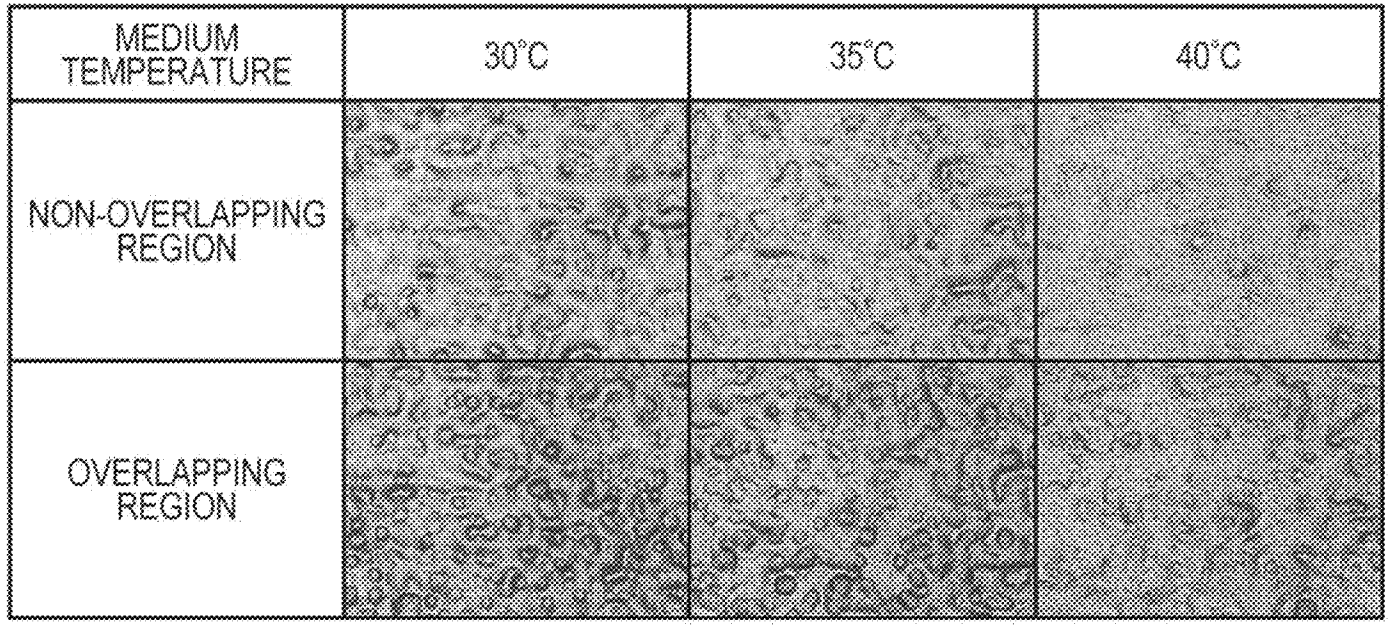
FIG. 18 is a plan view illustrating surface shapes of sequential dots in a non-overlapping region (landing time difference: 25 msec) and an overlapping region (landing time difference: 100 msec) which vary according to the medium temperature at the time of ink landing.

As illustrated in FIG. 16, the inkjet heads 2Y, 2M, 2C, and 2K for the respective colors in the recorder are each a line head. As illustrated in FIG. 2, each line head 150 includes an array of short head modules 150A and 150B. Each head module has a plurality of ink ejection ports 151 arranged in a line. The head modules 150A and 150B are arranged in the arrangement direction of the ink ejection ports 151 and overlap in an overlapping region ab. The head modules 150A and 150B are arranged over the entire width of the recording medium P (width in the direction orthogonal to the feeding direction), the number of which is such that at least the entire width of the recording medium P is covered. The number of head modules 150A and 150B is not limited at all. Each of the head modules 150A and 150B ejects the ink 7 through each of the ink ejection ports 151 toward the recording medium P.

The recording medium P and the line head 150 are moved relative to each other by the mover in a direction intersecting the arrangement direction of the ink ejection ports 151 in the line head 150 as indicated by arrow B. The mover causes each pair of ink ejection ports 151*a* and 151*b* of the two adjacent head modules 150A and 150B facing each other in the overlapping region ab to pass through the same place on the recording medium P. In this embodiment, each of the two adjacent head modules 150A and 150B has a plurality of ink ejection ports 151 in the overlapping region ab.

Figure 3:
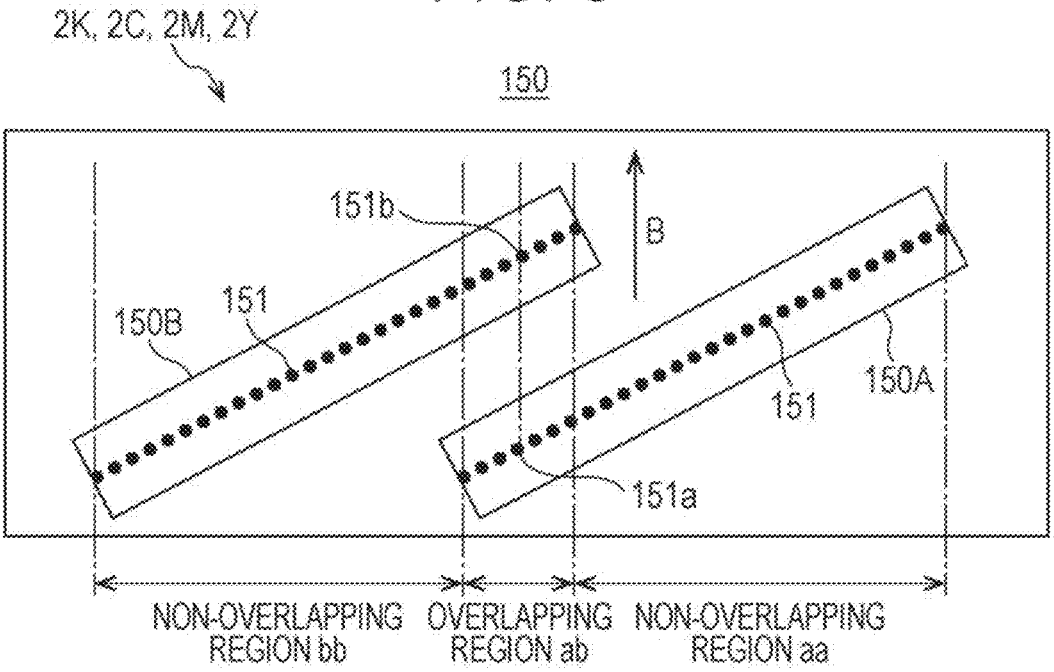
FIG. 3 is a schematic diagram illustrating another example of the main part of a line head of the inkjet recording apparatus according to the first embodiment.

FIG. 3 is a schematic diagram illustrating another example of the main part of a line head of the inkjet recording apparatus according to the first embodiment.

The relative movement direction of the recording medium P and the line head 150 is not limited to the direction orthogonal to the arrangement direction of the ink ejection ports 151 in the line head 150, and may be an obliquely intersecting direction as illustrated in FIG. 3. In this case, similarly, the mover causes each pair of ink ejection ports 151*a* and 151*b* of the two adjacent head modules 150A and 150B facing each other in the overlapping region ab to pass through the same place on the recording medium P.

Figure 4:
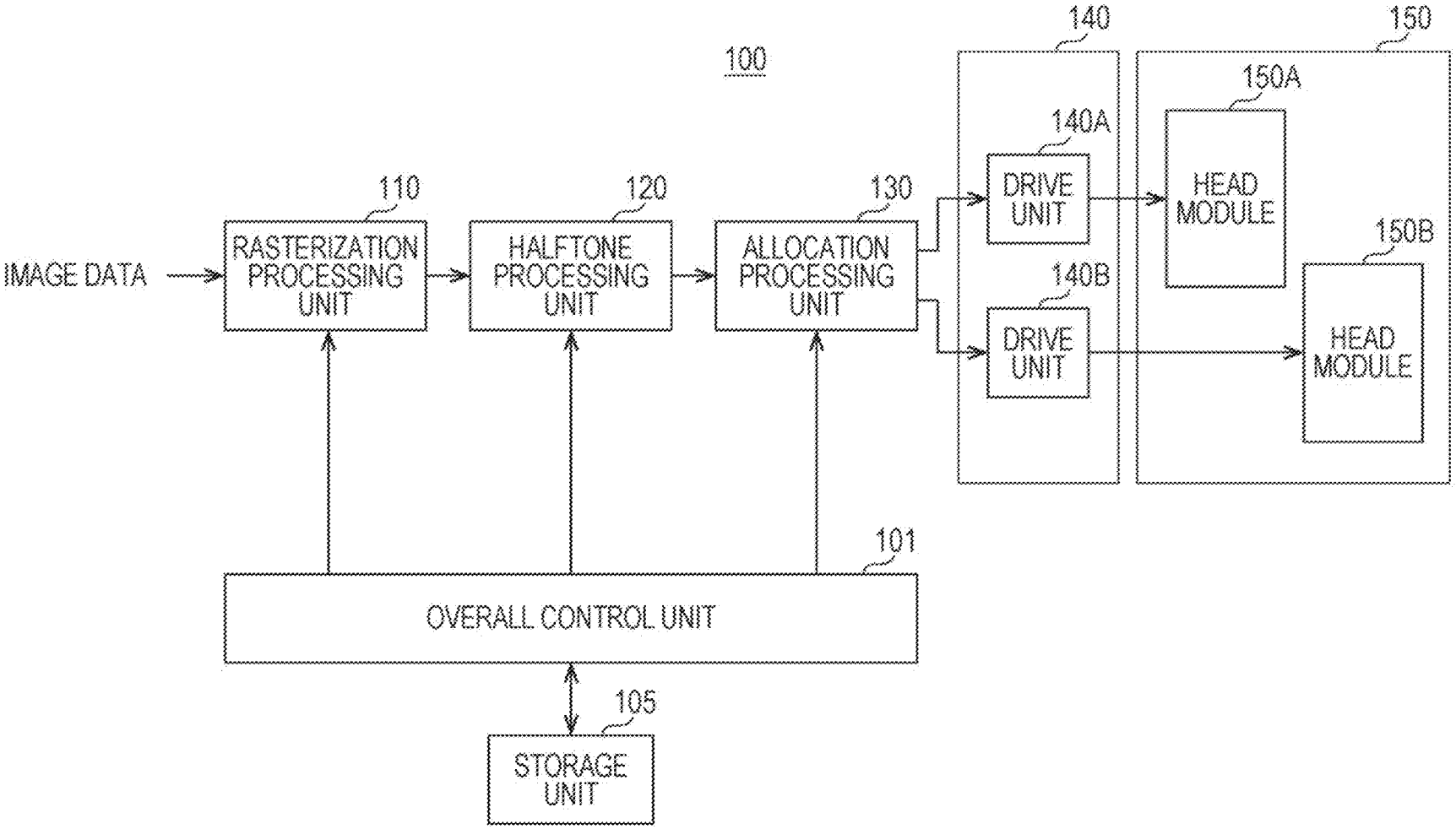
FIG. 4 is a block diagram illustrating a recording control device of the inkjet recording apparatus according to the first embodiment.

FIG. 4 is a block diagram illustrating a recording control device of the inkjet recording apparatus according to the first embodiment.

As illustrated in FIG. 4, the inkjet recording apparatus includes a recording control device 100 serving as a recording controller. Image data are input to the recording control device 100. The image data are converted into bitmap data in a rasterization processing unit 110 and sent to a halftone processing unit 120. The halftone processing unit 120 generates dot data from the bitmap data and sends the dot data to an allocation processing unit 130. In the overlapping region ab of the adjacent head modules 150A and 150B, the allocation processing unit 130 allocates dots of the same color to the head modules 150A and 150B so that the head modules 150A and 150B eject ink to form the allocated dots. This processing is performed for each color ink.

That is, the recording control device 100 controls the ink ejection operations of the plurality of head modules 150A and 150B on the recording medium P in accordance with dot data that are based on image data, and causes, in the overlapping region ab, either of a pair of ink ejection ports 151*a* and 151*b* of the two adjacent head modules 150A and 150B to eject ink to implement complementary ink ejection operations by the pair of ink ejection ports 151*a* and 151*b* of the two head modules 150A and 150B.

In the recording control device 100, the rasterization processing unit 110, the halftone processing unit 120, and the allocation processing unit 130 are controlled by an overall control unit 101. The overall control unit 101 is connected to a storage unit 105 that stores an inkjet recording program and other information. An inkjet recording method embodied as the operation of the recording control device 100 is implemented by the overall control unit 101 executing an inkjet recording program.

The dot data allocated by the allocation processing unit 130 are sent to either a drive unit 140A that drives the upstream head module 150A or a drive unit 140B that drives the downstream head module 150B. The upstream drive unit 140A drives the upstream head module 150A, and the downstream drive unit 140B drives the downstream head module 150B. Note that the recording control device 100 also controls the feeding operation of the conveying belt 1.

Figure 5:
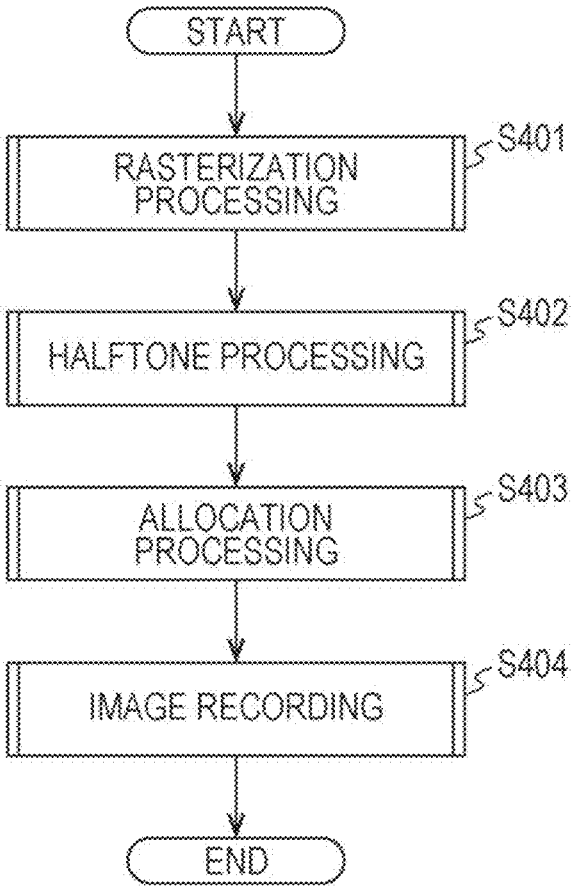
FIG. 5 is a flowchart illustrating an inkjet recording program according to the first embodiment.

FIG. 5 is a flowchart illustrating an inkjet recording program according to the first embodiment.

As illustrated in FIG. 5, in response to the overall control unit 101 starting the inkjet recording program, the recording control device 100 proceeds to S401, where the rasterization processing unit 110 executes rasterization processing. Next, in step S402, the halftone processing unit 120 executes halftone processing. Next, in step S403, the allocation processing unit 130 executes allocation processing. Then, in step S404, image recording, i.e. conveyance of the recording medium P and ink ejection from the line head 150, is performed, and the inkjet recording program is terminated (end).

Figure 6A:
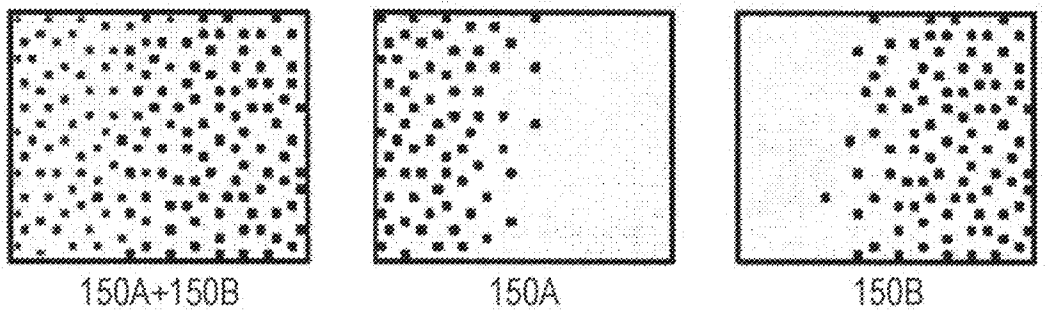
FIGS. 6A to 6C are plan views illustrating dots allocated in the inkjet recording apparatus according to the first embodiment.
Figure 6B:
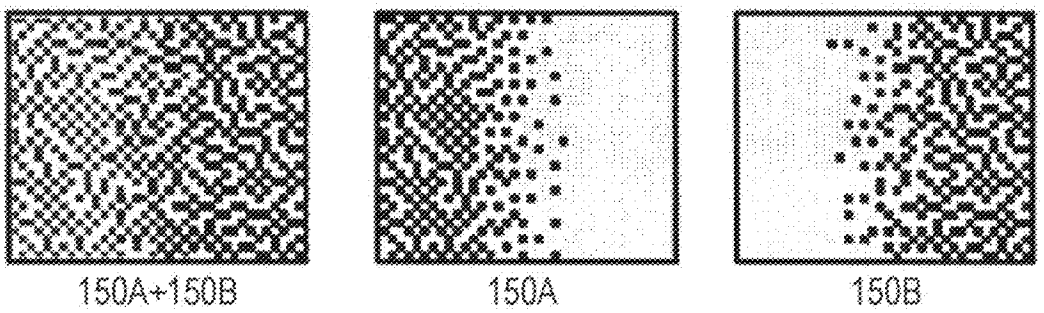
Figure 6C:
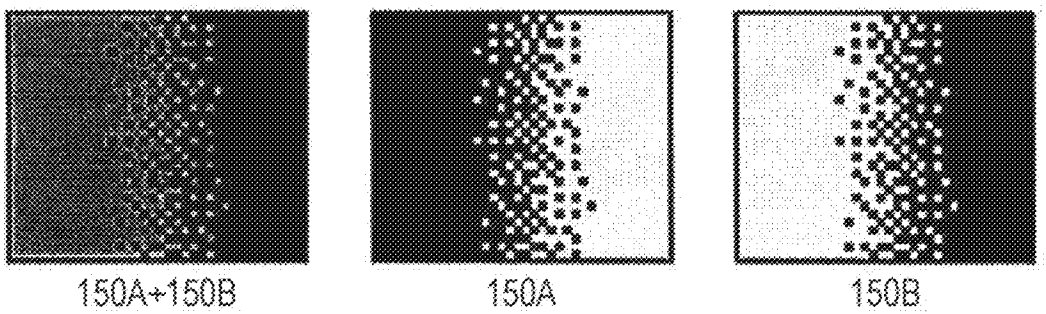

FIGS. 6A to 6C are plan views illustrating dots allocated in the inkjet recording apparatus according to the first embodiment.

In the overlapping region ab of the adjacent head modules 150A and 150B, as illustrated in FIGS. 6A to 6C, ink is ejected from either of a pair of ink ejection ports 151*a* and 151*b* of the two adjacent head modules 150A and 150B, so that complementary ink ejection operations are performed by the two head modules 150A and 150B. FIG. 6A depicts a case where a low-density image is formed in the overlapping region ab. The upstream head module 150A ejects mainly to the left side in the figure, and the downstream head module 150B ejects mainly to the right side in the figure. The combination of them forms a light-colored image corresponding to the image data. In FIGS. 6A to 6C, the dots formed by one head module 150A are distinguished from the dots formed by the other head module 150B with different densities for convenience of explanation. In practice, however, the head modules constituting the same line head form dots of the same color. FIG. 6B depicts a case where a medium-density image is formed in the overlapping region ab. The upstream head module 150A ejects mainly to the left side in the figure, and the downstream head module 150B ejects mainly to the right side in the figure. The combination of them forms a medium-density image corresponding to the image data. FIG. 6C depicts a case where a high-density image is formed in the overlapping region ab. The upstream head module 150A ejects mainly to the left side in the figure, and the downstream head module 150B ejects mainly to the right side in the figure. The combination of them forms a dark-colored image corresponding to the image data.

Figure 7A:
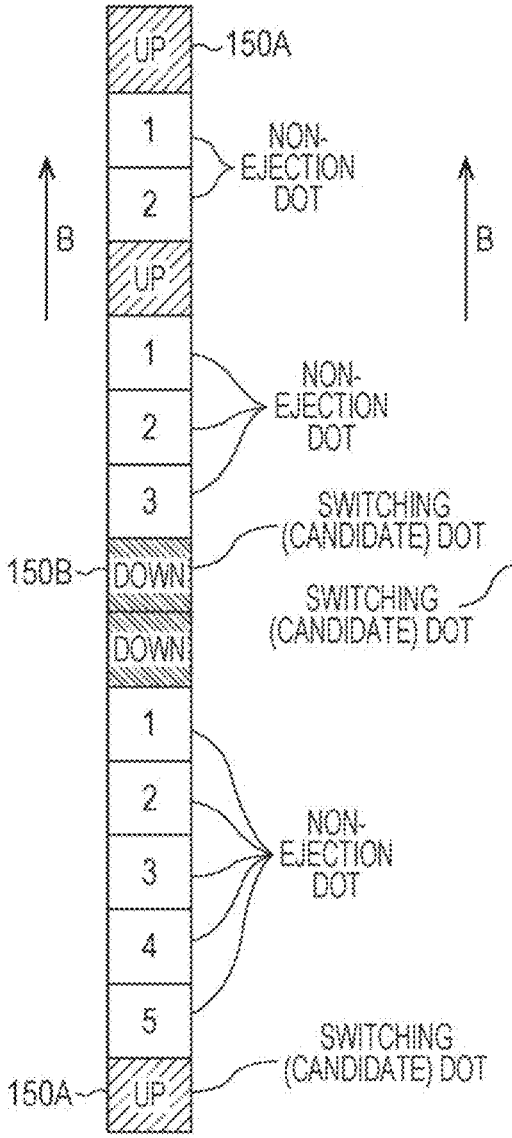
FIGS. 7A to 7C are schematic diagrams illustrating dot data in which switching is performed between head modules.
Figure 7B:
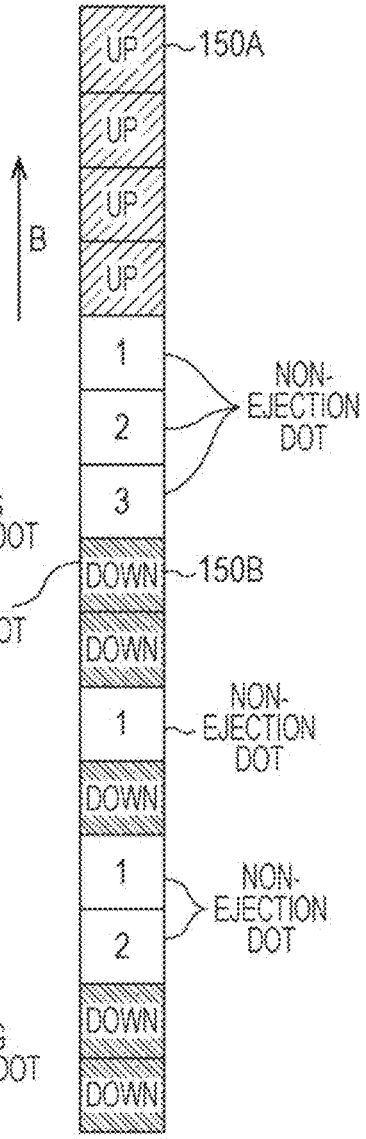
Figure 7C:
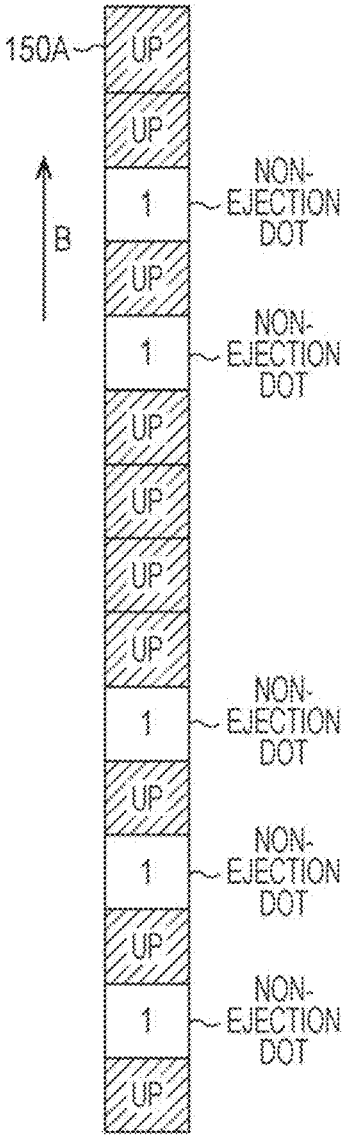

FIGS. 7A to 7C are schematic diagrams illustrating dot data in which switching is performed between head modules.

As illustrated in FIGS. 7A to 7C, the recording control device 100 performs allocation processing in the overlapping region ab by switching from ink ejection from one of a pair of ink ejection ports 151*a* and 151*b* to ink ejection from the other ink ejection port when at least one condition is satisfied. At least one condition for switching between ink ejection ports is that a non-ejection section (non-ejection dot) has continued for a predetermined length or more in the dot data.

FIGS. 7A to 7C depict examples in which after a non-ejection section lasts for three pixels or more, switching is performed to ejection from the ink ejection port of the other head module. In FIG. 7A, since the first non-ejection section has two pixels, switching is not performed. Since the next non-ejection section has three pixels, switching is performed from the upstream head module 150A to the downstream head module 150B. Since the next non-ejection section has five pixels, switching is performed from the downstream head module 150B to the upstream head module 150A.

In FIG. 7B, since the first non-ejection section has three pixels, switching is performed from the upstream head module 150A to the downstream head module 150B. Since the subsequent non-ejection sections have one pixel and two pixels, no switching is performed in either section. In FIG. 7C, since every non-ejection section has one pixel, no switching is performed in any section.

Figure 8:
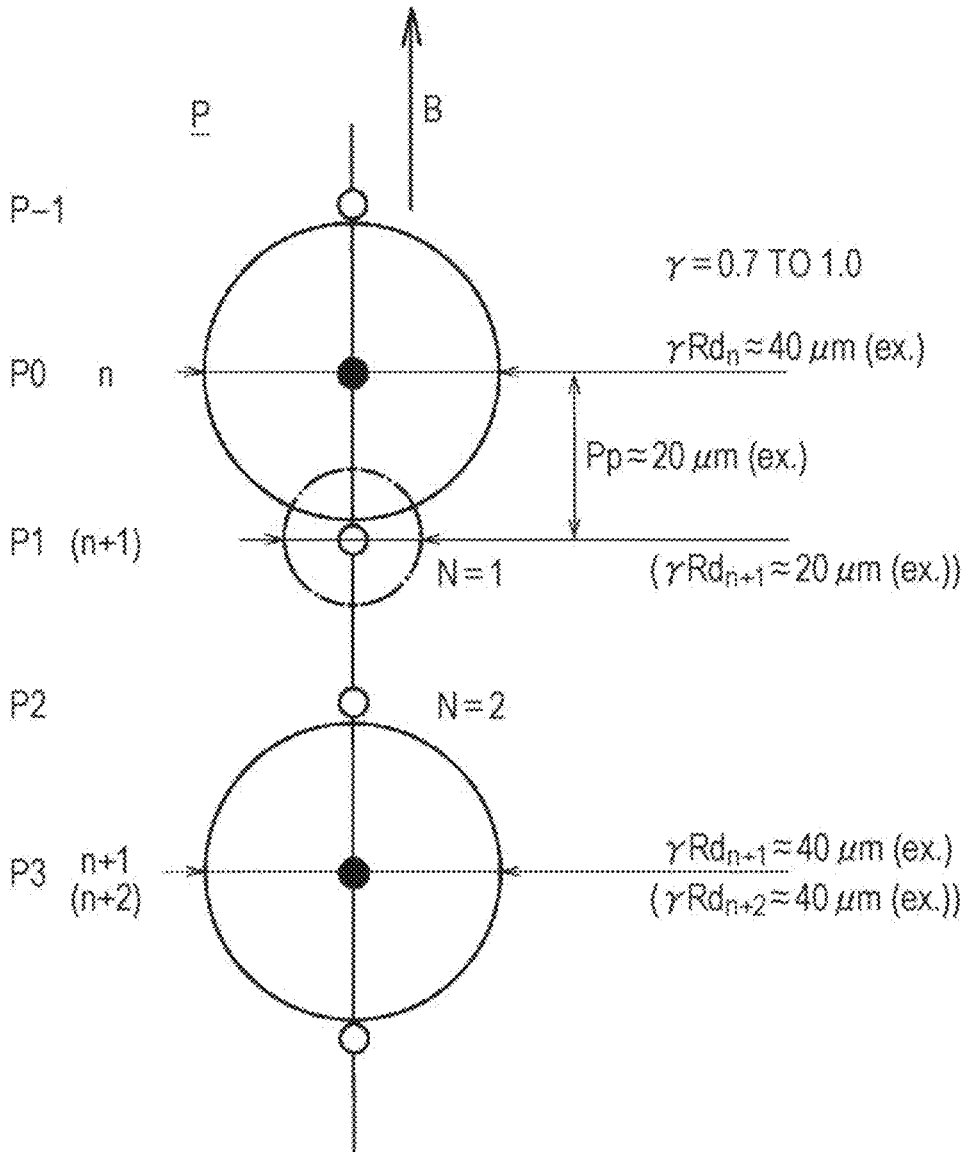
FIG. 8 is a plan view illustrating the relationship between the pixel pitch and the dot diameter on a recording medium.

FIG. 8 is a plan view illustrating the relationship between the pixel pitch and the dot diameter on a recording medium.

In this embodiment, a non-ejection section with a predetermined length or more, after which switching is performed between the head modules 150A and 150B, has a length that satisfies $$N>(\gamma Rd/Pp)-1$$

derived from $$Pp(N+1)>\gamma Rd$$

where Rd is the maximum diameter of the dot formed on the recording medium P by an ink droplet ejected from the ink ejection port 151, the coefficient γ (=0.7 to 1.0) is the ratio of the effective diameter to the maximum diameter Rd, Pp is the pixel pitch on the recording medium P, and N (integer) is the number of non-ejection pixels in the non-ejection section, as illustrated in FIG. 8. If the number N of non-ejection pixels satisfies this condition the dots n and n+1 before and after these non-ejection pixels will not overlap or connect.

In this embodiment, FIG. 8 shows that the two pixels (pixels P1 and P2) between the first dot n (pixel P0) and the second dot n+1 (pixel P3) are non-ejection pixels. When the effective diameter γRd of the maximum dot diameter is 40 μm and the pixel pitch Pp is 20 μm.

$$N>(40/20)-1=1$$

is obtained, so

N is two.

Figure 9:
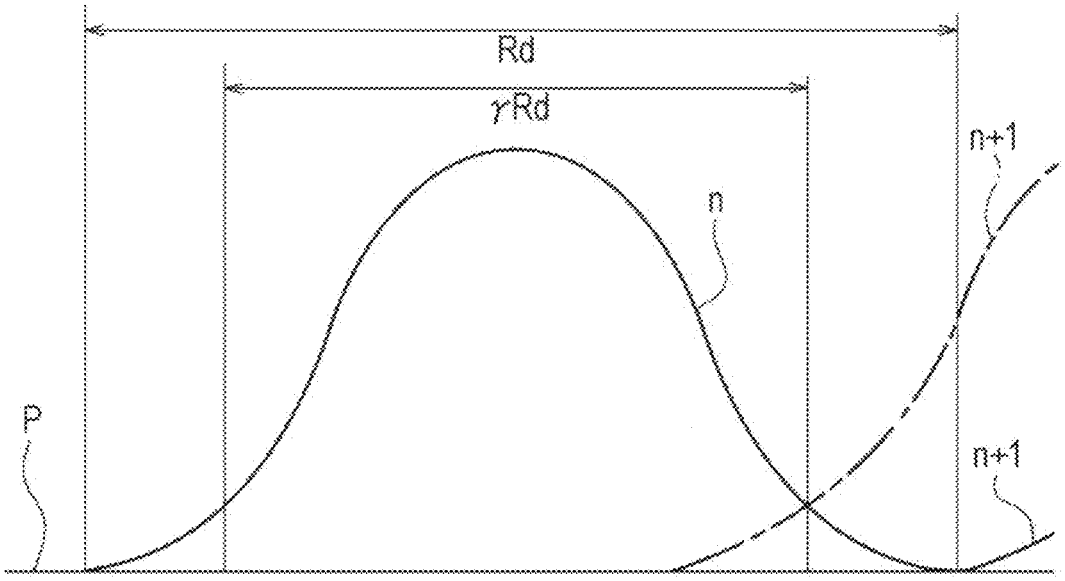
FIG. 9 is a side view illustrating the relationship between the maximum dot diameter Rd and the effective diameter γRd.

FIG. 9 is a side view illustrating the relationship between the maximum dot diameter Rd and the effective diameter γRd.

As illustrated in FIG. 9, the maximum dot diameter Rd is the outermost diameter of the largest dot formed by the ink landed on the recording medium P, and is the diameter of a perfect circle that is fit to an area having a density of 80% or more in terms of the contrast between the white paper and the dot center density when the optical density on the recording medium P is observed with a microscope. The outermost peripheral part of a dot has a thin ink layer. Therefore, adjacent dots n and n+1 that overlap in the outermost peripheral parts are not united entirely, depending on the viscosity of the ink. Adjacent dots n and n+1 that overlap in ink layers with a certain thickness are united entirely. Thus, the outer diameter of a part of a dot where the ink layer has a thickness that causes the dot to be united entirely with an adjacent dot is the effective diameter γRd in the present invention, and the ratio of the effective diameter γRd to the maximum diameter Rd is the coefficient γ. The coefficient γ is in the range of 0.7 to 1.0 and varies depending on the viscosity of the ink and the surface state of the recording medium P. Therefore, the coefficient γ is determined through an experiment that examines whether dots are united entirely.

Note that the above-mentioned switching between head modules in the overlapping region ab is preferably performed for bit data in which pixels are not 100% filled in halftone processing. Switching is highly effective when the halftone pattern is a low frequency response pattern such as green noise. The same applies to the other embodiments described later.

When a two-component reactive phase change ink (one that starts undergoing a phase change as soon as it is landed on the recording medium P) is used, the ink starts reacting as soon as it is landed on the recording medium P. However, the ink requires some time to finish reacting, which may result in a difference in gloss as described above. The present embodiment can prevent such a difference in gloss. The same applies to the other embodiments described later.

When the recording medium P is a permeable medium, if sequential (adjacent) dots are formed by the same head module with a small time difference, the first dot serves as priming water and draws the second dot. Therefore, the dot gain of these dots is different from that of sequential (adjacent) dots formed by different head modules with a large time difference. In such a case, the present embodiment can prevent a difference in dot gain between sequential (adjacent) dots, and can eliminate unevenness in image quality between overlapping and non-overlapping regions. The same applies to the other embodiments described later.

Second Embodiment

In the first embodiment, a non-ejection section with a predetermined length or more, after which switching is performed between the head modules 150A and 150B, is calculated using the maximum dot diameter Rd. However, some types of head modules can produce dots of different sizes, and in the case of using such head modules, dot diameters on the recording medium P can vary from pixel to pixel. In this case, it is not always necessary to use the maximum diameter to prevent adjacent dots from overlapping or connecting. In other words, dots having a small diameter do not overlap or connect even with a short non-ejection section therebetween, enabling switching between the head modules 150A and 150B.

In this embodiment, a non-ejection section with a predetermined length or more has a length that satisfies $$N>\{\gamma(Rd_n+Rd_{n+1})/2Pp\}-1$$

derived from $$Pp(N+1)>\gamma(Rd_n+Rd_{n+1})/2$$

where $Rd_n$ is the diameter of the dot formed on the recording medium P by an ink droplet ejected from the ink ejection port 151, $Rd_{n+1}$ is the diameter of the dot formed on the recording medium P by the next ink droplet ejected, the coefficient γ (=0.7 to 1.0) is the ratio of the effective diameter to the dot diameters $Rd_n$ and $Rd_{n+1}$, Pp is the pixel pitch on the recording medium P, and N (integer) is the number of non-ejection pixels in the non-ejection section, as illustrated in FIG. 8.

In this embodiment, FIG. 8 shows that the one pixel (pixel P2) between the second dot n+1 (pixel P1) and the third dot n+2 (pixel P3) is a non-ejection pixel. When the effective diameter $\gamma Rd_{n+1}$ of the second dot n+1 is 20 μm, the effective diameter $\gamma Rd_{n+2}$ of the third dot n+2 is 40 μm, and the pixel pitch Pp is 20 μm, $$N>((20+40)/2)/20-1=0.5$$

is obtained, so

N is one.

<Operation of Inkjet Recording Apparatus in First and Second Embodiments (Inkjet Recording Method and Inkjet Recording Program)>

Figure 10:
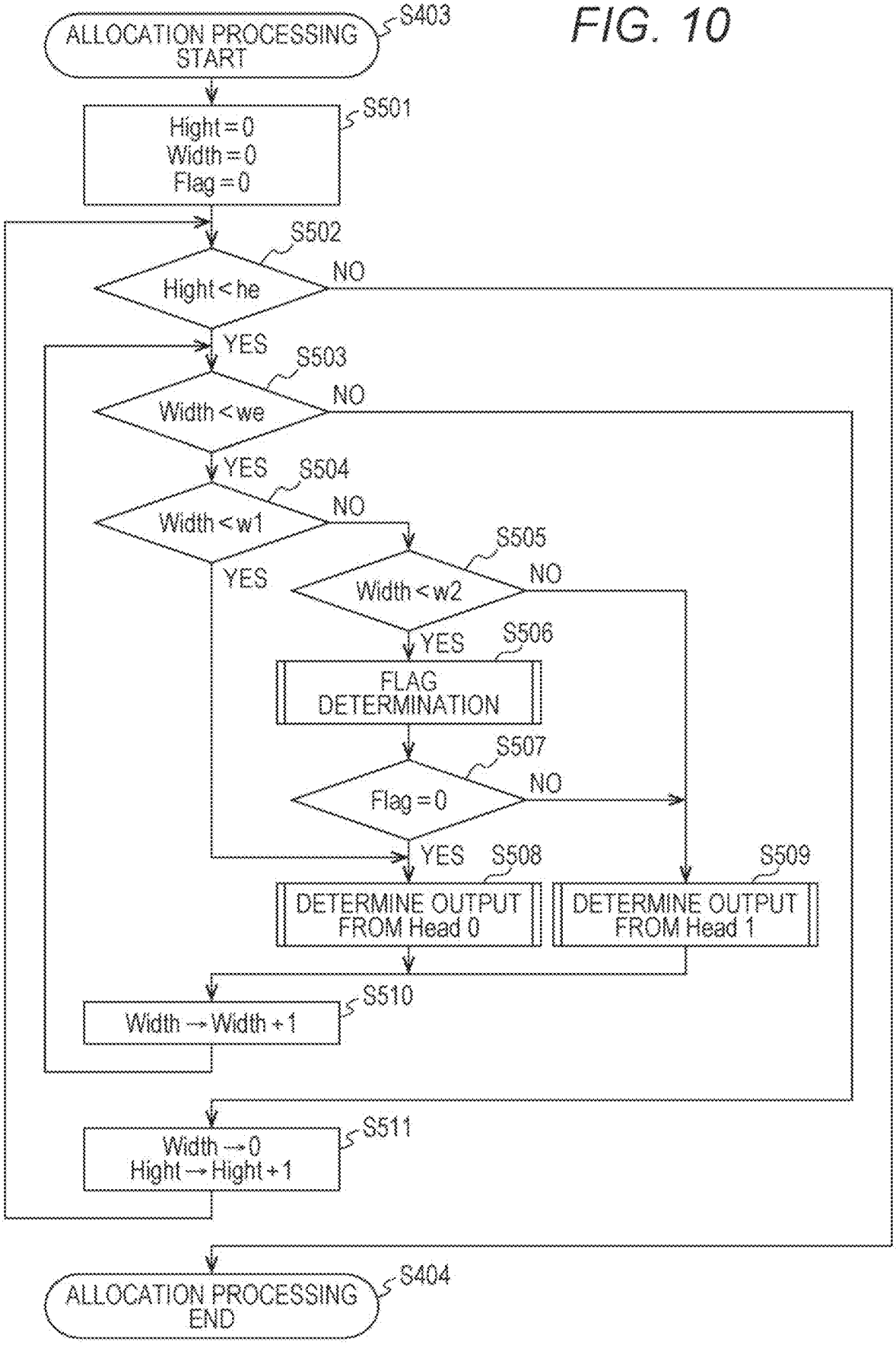
FIG. 10 is a flowchart illustrating the allocation processing of an inkjet recording program according to the first and second embodiments.

FIG. 10 is a flowchart illustrating the allocation processing of an inkjet recording program according to the first and second embodiments.

In the first and second embodiments described above, in response to starting the allocation processing in S403 of FIG. 5, the recording control device 100 proceeds to S501 and sets "Hight=0, Width=0, Flag=0", as illustrated in FIG. 10. "Hight" is a coordinate in the feeding direction of the recording medium P, and "0" indicates the coordinate of the start edge of the image data in this direction. "Width" is a coordinate in the width direction of the recording medium P (arrangement direction of the ink ejection ports), and "0" indicates the coordinate of the start edge of the image data in this direction. "Flag" is a code that designates the head module 150A or 150B in the overlapping region ab, and "0" indicates the upstream head module 150A while a code other than "0" (for example, "1") indicates the downstream head module 150B.

Next, in step S502, it is determined whether the coordinate "Hight" of an allocation target dot in the feeding direction of the recording medium P is smaller than "he". Here, "he" indicates the coordinate of the end point of the image data in the feeding direction of the recording medium P. If "Hight<he" is satisfied, the dot is an allocation target, therefore the processing advances to step S503. If "Hight≥he" is satisfied, the dot is at or beyond the end point of the image data in the feeding direction of the recording medium P, therefore the allocation processing is terminated, and the processing returns to S404 of FIG. 5.

In S503, it is determined whether the coordinate "Width" in the width direction of the recording medium P is smaller than "we". Here, "we" indicates the coordinate of the end point of the image data in the width direction of the recording medium P. If "Width<we" is satisfied, the dot is an allocation target, therefore the processing advances to step S504. If "Width≥we" is satisfied, the dot is at or beyond the end point of the image data in the width direction of the recording medium P, therefore the processing advances to S511.

In S504, it is determined whether the coordinate "Width" in the width direction of the recording medium P is smaller than "w1". Here, "w1" is the coordinate of the entrance from the non-overlapping region a of the upstream head module 150A to the overlapping region ab. If "Width<w1" is satisfied, the dot is within the non-overlapping region a of the upstream head module 150A, therefore the processing advances to S508. If "Width≥w1" is satisfied, the dot is in the overlapping region ab, therefore the processing advances to S505. Note that one line head 150 may include a plurality of "w1" values.

In S505, it is determined whether the coordinate "Width" in the width direction of the recording medium P is smaller than "w2". Here, "w2" is the coordinate of the entrance from the overlapping region ab to the non-overlapping region b of the downstream head module 150B. If "Width<w2" is satisfied, the dot is within the overlapping region ab, therefore the processing advances to S506. If "Width≥w2" is satisfied, the dot is beyond the overlapping region ab, therefore the processing advances to S509. Note that one line head 150 may include a plurality of "w2" values.

In S506, flag determination is performed, and the processing advances to S507. The flag determination is a determination as to whether to leave "Flag" at "0" or switch (change) it to a code other than "0". Details of the determination will be described later.

In S507, it is determined whether "Flag" is "0". If "Flag=0" is satisfied, the processing advances to S508, and if "Flag≠0" is satisfied, the processing advances to S509.

In S508, the dot is determined to be formed by the upstream head module 150A (head 0), and the processing advances to S510.

In S509, the dot is determined to be formed by the downstream head module 150B (head 1), and the processing advances to S510.

In S510, the coordinate "Width" is incremented by one pixel to "Width+1", and the processing returns to S503, where the next dot in the width direction of the recording medium P undergoes the allocation processing.

In S511, the coordinate "Width" is returned to "0" (start edge), and the coordinate "Hight" is incremented by one pixel to "Hight+1". Then, the processing returns to S502, where the next dot in the feeding direction of the recording medium P undergoes the allocation processing.

Figure 11:
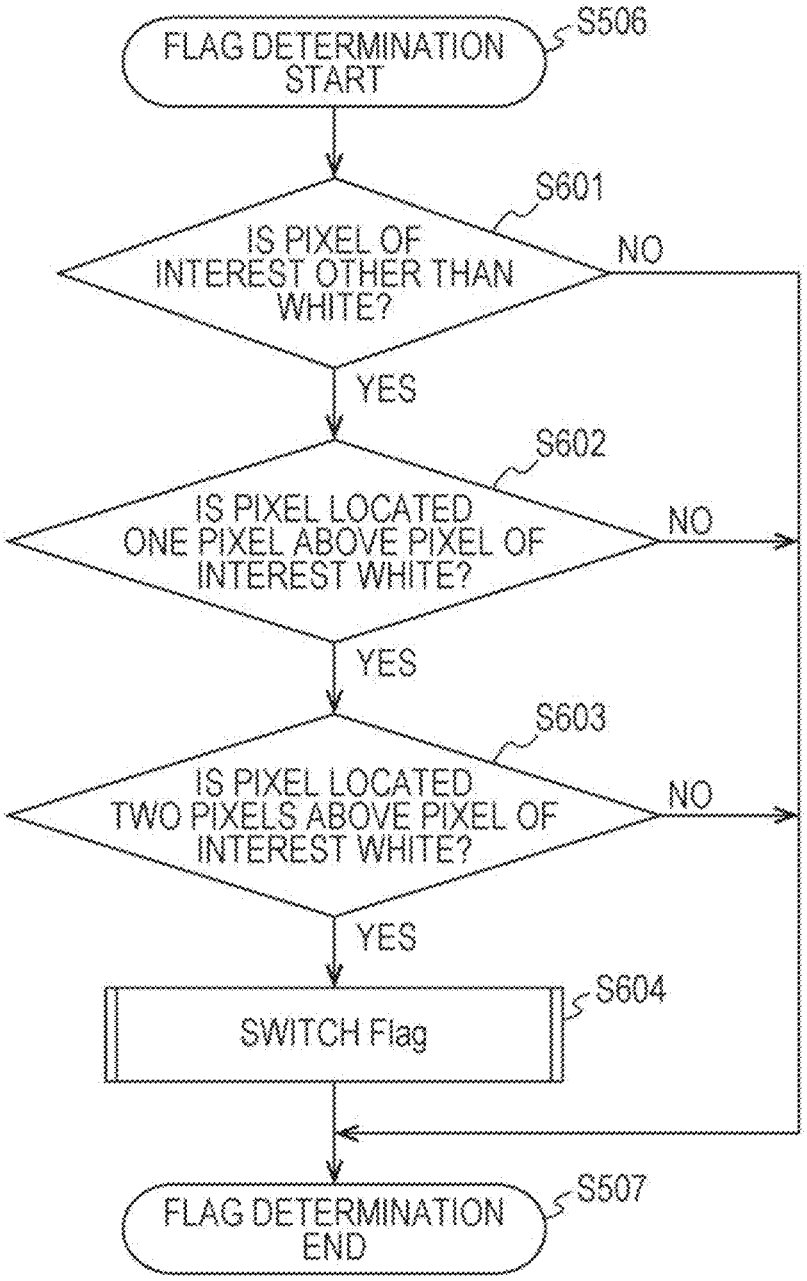
FIG. 11 is a flowchart illustrating the flag determination of the inkjet recording program according to the first and second embodiments.

FIG. 11 is a flowchart illustrating the flag determination of the inkjet recording program according to the first and second embodiments.

As illustrated in FIG. 11, in response to starting the flag determination in S506 of FIG. 10, the recording control device 100 proceeds to S601 and determines whether the pixel of interest (determination target dot) is not a white pixel (non-ejection dot). If the pixel of interest is not a white pixel, the processing advances to S602, and if the pixel of interest is a white pixel, the flag determination is terminated, and the processing returns to S507 of FIG. 10.

In S602, it is determined whether the pixel located one pixel above the pixel of interest (the pixel ejected one pixel ahead) is a white pixel. If it is a white pixel, the processing advances to S603, and if it is not a white pixel, the flag determination is terminated, and the processing returns to S507 of FIG. 10.

In S603, it is determined whether the pixel located two pixels above the pixel of interest (the pixel ejected two pixels ahead) is a white pixel. If it is a white pixel, the processing advances to S604, and if it is not a white pixel, the flag determination is terminated, and the processing returns to S507 of FIG. 10. In this embodiment, these two pixels correspond to a non-ejection section with a predetermined length or more for switching from one of a pair of ink ejection ports 151*a* and 151*b* to the other.

In S604, "Flag" is switched (changed) from "0" to a code other than "0" or from a code other than "0" to "0". Then, the flag determination is terminated, and the processing returns to S507 of FIG. 10.

Third Embodiment

Figure 12:
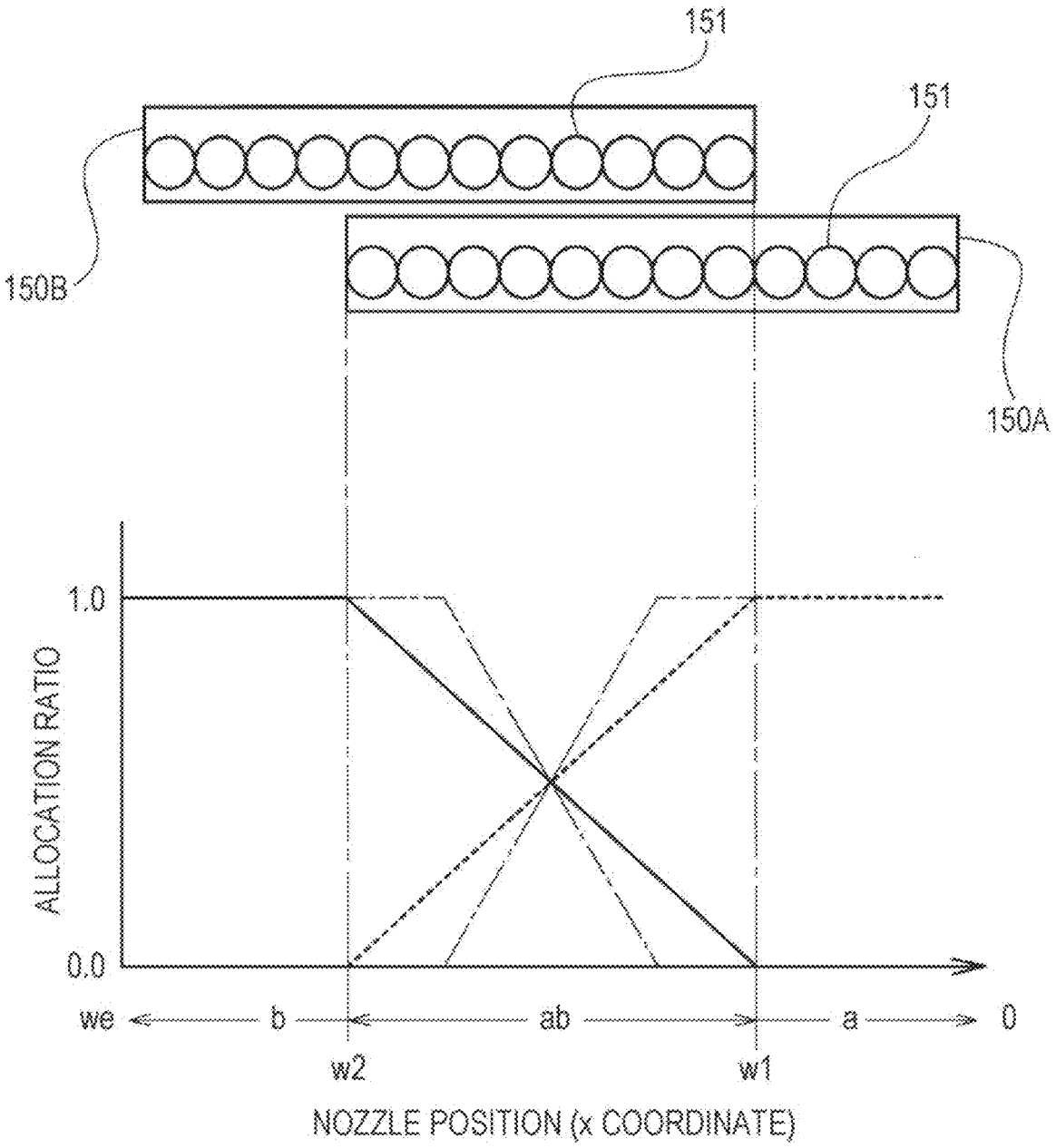
FIG. 12 is a schematic diagram illustrating the main part and the allocation ratio of a line head of an inkjet recording apparatus according to a third embodiment.

FIG. 12 is a schematic diagram illustrating the main part and the allocation ratio of a line head of an inkjet recording apparatus according to the third embodiment.

In this embodiment, as illustrated in FIG. 12, in one head module 150A or 150B, the overlapping region ab and the non-overlapping region a or b extending from the overlapping region ab each include a plurality of ink ejection ports 151, and throughout the overlapping region ab of the one head module 150A or 150B from the boundary between the overlapping region ab and the non-overlapping region a or b, the recording control device 100 gradually changes the selection ratio (allocation ratio) for selecting ink ejection from the ink ejection ports 151 of this head module 150A or 150B.

Specifically, in the overlapping region ab of the upstream head module 150A, the allocation ratio gradually decreases from 100% at the position closest to the non-overlapping region a to 0% at the position farthest from the non-overlapping region a. Similarly, in the overlapping region ab of the downstream head module 150B, the allocation ratio gradually decreases from 100% at the position closest to the non-overlapping region b to 0% at the position farthest from the non-overlapping region b. At any position in the overlapping region ab, the sum of the allocation ratios of the two head modules 150A and 150B is 100%.

Figure 13A:
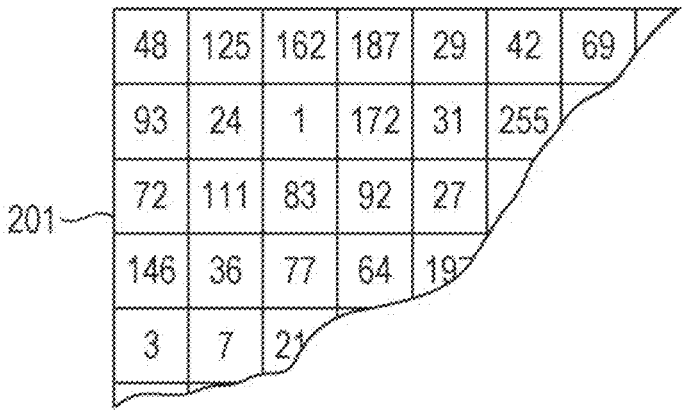
FIGS. 13A and 13B are schematic diagrams illustrating the flag determination operation of the inkjet recording apparatus according to the third embodiment.
Figure 13B:
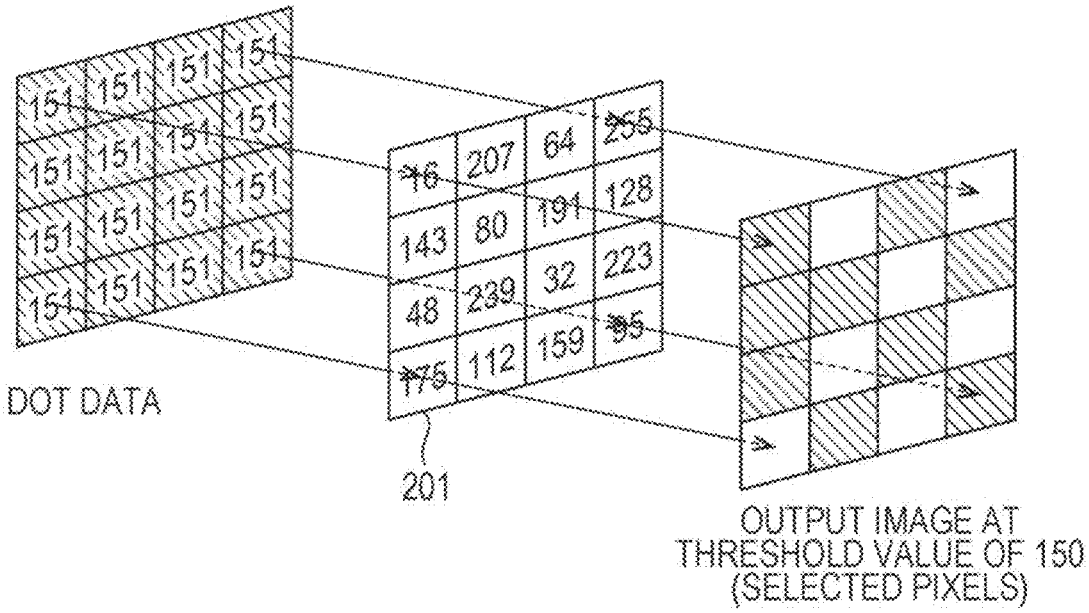

FIGS. 13A and 13B are schematic diagrams illustrating the flag determination operation of the inkjet recording apparatus according to the third embodiment.

A second condition for switching between ink ejection ports is that an ink ejection port has been selected using a threshold matrix 201 based on a selection ratio gradient table defined within the overlapping region, as illustrated in FIGS. 13A and 13B, and the selection ratio is changed by the recording control device 100 switching from ink ejection from one ink ejection port to ink ejection from the other ink ejection port when the two conditions are satisfied.

In the threshold matrix 201, random numbers are associated one-to-one with pixels. If a random number is larger than a threshold value, one ink ejection port is selected, and if a random number is equal to or less than a threshold value, the other ink ejection port is selected. Positions closer to the non-overlapping region have smaller threshold values, and positions farther from the non-overlapping region have larger threshold values. Consequently, the allocation ratio gradually decreases as it is farther from the non-overlapping region. Such a gradient for threshold values is specified in the selection ratio gradient table.

Figure 14:
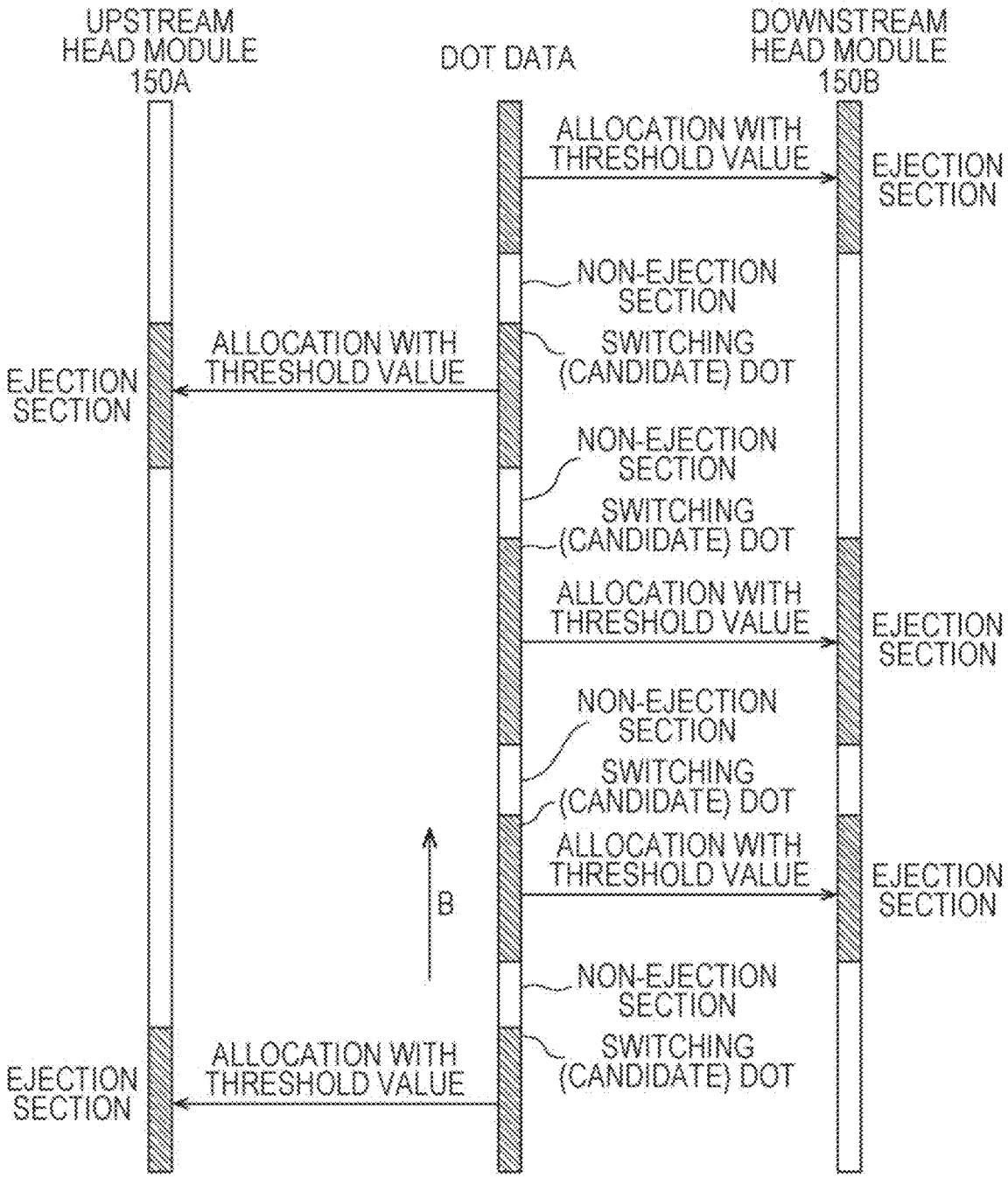
FIG. 14 is a schematic diagram illustrating allocation in a line head of the inkjet recording apparatus according to the third embodiment.

FIG. 14 is a schematic diagram illustrating allocation in a line head of the inkjet recording apparatus according to the third embodiment.

When an ink ejection port is selected using the threshold matrix 201, as illustrated in FIG. 14, in the dot data, one or more dots in the ejection section between a non-ejection section with a predetermined length or more and the next non-ejection section with a predetermined length or more are integrally allocated to the upstream head module 150A or the downstream head module 150B according to the selection using the threshold matrix 201. That is, switching between the head modules 150A and 150B is performed when the two conditions that a non-ejection section has continued for a predetermined length or more and that an ink ejection port has been selected using the threshold matrix 201 are satisfied.

Note that different selection ratio gradient tables may be used, depending on image data. For example, it is preferable that a selection ratio gradient table for image data with a higher recording density have a steeper gradient for threshold value change, as indicated by the dashed-dotted line in FIG. 12. A steeper gradient for threshold value change means that allocation to the head modules 150 and 150B is performed in a narrower region. When the recording density of image data is high, dots overlap each other. Therefore, it is necessary to place more importance on gloss fluctuation than density fluctuation. Thus, in terms of visibility improvement, it is better to narrow the joint width (allocation region) and narrow the gloss change region.

Switching (allocation) between head modules in this embodiment may be performed using, for example, a dither matrix for performing dithering-based halftone processing, instead of the threshold matrix 201. In this case, if the spatial frequency of the dither matrix is different from the spatial frequency of the halftone, the probability that an overlapping pattern will occur at a high frequency increases, and the dot dispersion performance (allocation to different head modules) in the overlapping region ab can be improved.

Figure 15:
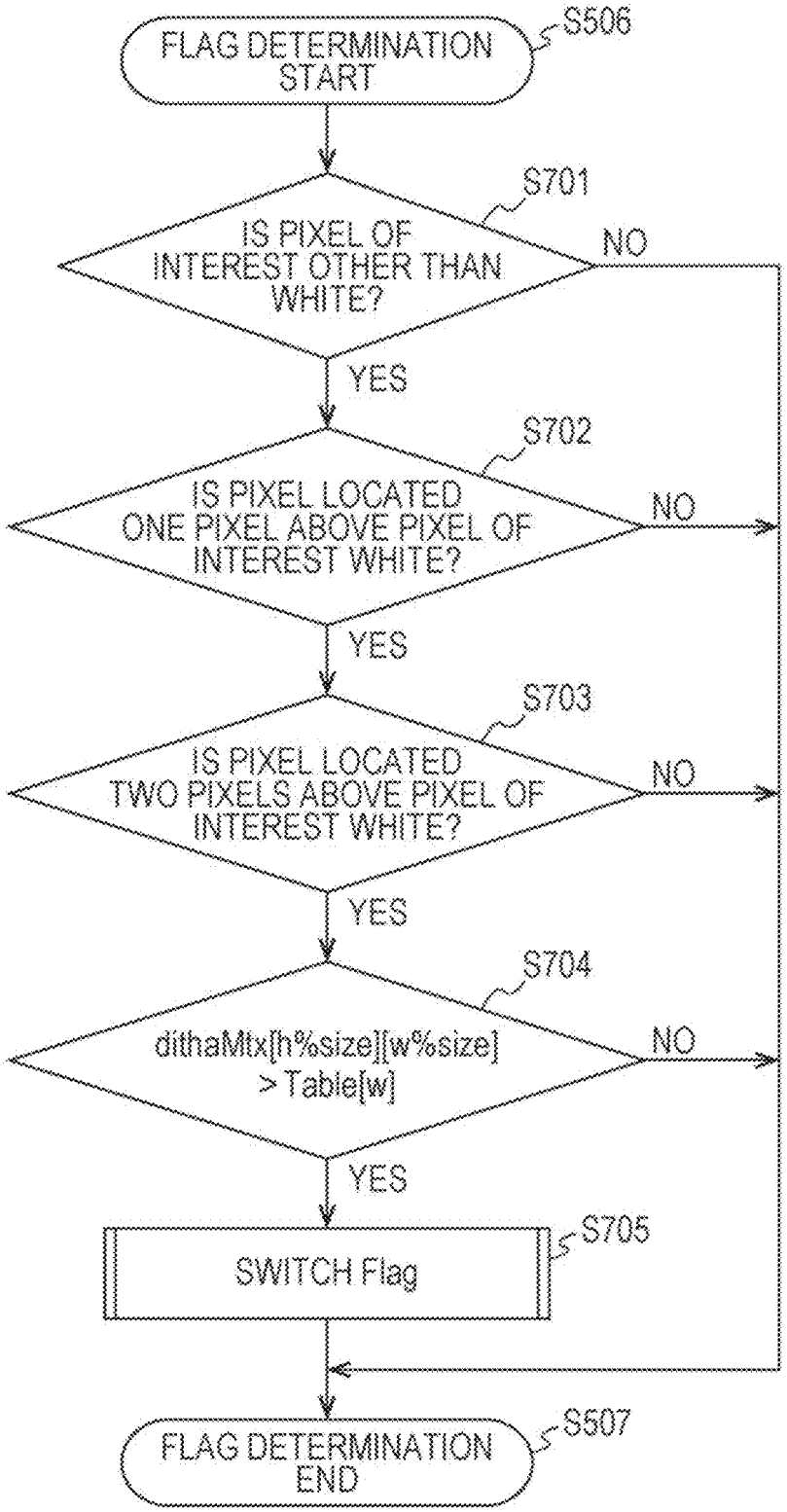
FIG. 15 is a flowchart illustrating the allocation processing of an inkjet recording program according to the third embodiment.

FIG. 15 is a flowchart illustrating the allocation processing of an inkjet recording program according to the third embodiment.

In this embodiment, as illustrated in FIG. 15, in response to starting the flag determination in S506 of FIG. 10, the recording control device 100 proceeds to S701 and determines whether the pixel of interest (determination target dot) is not a white pixel (non-ejection dot). If the pixel of interest is not a white pixel, the processing advances to S702, and if the pixel of interest is a white pixel, the flag determination is terminated, and the processing returns to S507 of FIG. 10.

In S702, it is determined whether the pixel located one pixel above the pixel of interest (the pixel ejected one pixel ahead) is a white pixel. If it is a white pixel, the processing advances to S703, and if it is not a white pixel, the flag determination is terminated, and the processing returns to S507 of FIG. 10.

In S703, it is determined whether the pixel located two pixels above the pixel of interest (the pixel ejected two pixels ahead) is a white pixel. If it is a white pixel, the processing advances to S704, and if it is not a white pixel, the flag determination is terminated, and the processing returns to S507 of FIG. 10. In this embodiment, these two pixels correspond to a non-ejection section with a predetermined length or more for switching from one of a pair of ink ejection ports 151*a* and 151*b* to the other.

In S704, selection is performed using the threshold matrix 201. If the determination target head module is selected, switching is not performed. Therefore, the flag determination is terminated, and the processing returns to S507 of FIG. 10. If the other head module is selected, the processing advances to S705 for switching.

In S705, "Flag" is switched (changed) from "0" to a code other than "0" or from a code other than "0" to "0", the flag determination is terminated, and the processing returns to S507 of FIG. 10.

In the examples described in the above embodiments, the present invention is applied to an inkjet recording apparatus that forms a color image. However, the present invention can also be applied to an inkjet recording apparatus that forms a monochrome image. Specific configurations, shapes, materials, operations, numerical values, and the like in the description of the above embodiments are merely examples for explaining the present invention, and the present invention should not be interpreted in a limited way by these.

According to an embodiment of the present invention, it is possible to provide a single pass inkjet recording apparatus that prevents image quality deterioration in an overlapping region (joint) of head modules, and an inkjet recording method and an inkjet recording program therefor.

Although embodiments of the present invention have been described and illustrated in detail, the disclosed embodiments are made for purposes of illustration and example only and not limitation. The scope of the present invention should be interpreted by terms of the appended claims.

What is claimed is:

1. An inkjet recording apparatus comprising:

a recorder having a line head, the line head including a plurality of head modules each having a plurality of ink ejection ports arranged in a line, the head modules being arranged in an arrangement direction of the ink ejection ports and overlapping in an overlapping region, the recorder ejecting ink through each of the ink ejection ports toward a recording medium;

a mover that moves the recording medium and the line head relative to each other in a direction intersecting the arrangement direction of the ink ejection ports in the line head, and causes each pair of ink ejection ports of two adjacent head modules facing each other in the overlapping region to pass through a same place on the recording medium; and a recording controller that controls ink ejection operations of the plurality of head modules on the recording medium in accordance with dot data that are based on image data, and causes, in the overlapping region, either of a pair of ink ejection ports of two adjacent head modules to eject ink to implement complementary ink ejection operations by the pair of ink ejection ports of the two head modules, wherein in the overlapping region, the recording controller switches from ink ejection from one of a pair of ink ejection ports to ink ejection from the other ink ejection port when at least one condition is satisfied, and the one condition is that a non-ejection section has continued for a predetermined length or more in the dot data.

2. The inkjet recording apparatus according to claim 1, wherein the ink thickens due to a phase change after being landed on the recording medium.

3. The inkjet recording apparatus according to claim 2, wherein the recording medium is coated with a pretreatment material, and the ink undergoes the phase change by reacting with the pretreatment material.

4. The inkjet recording apparatus according to claim 1, wherein the non-ejection section with a predetermined length or more has a length that satisfies $$N>(\gamma Rd/Pp)-1$$

where Rd is a maximum diameter of a dot formed on the recording medium by an ink droplet ejected from the ink ejection port, a coefficient γ (=0.7 to 1.0) is a ratio of an effective diameter to the maximum diameter Rd, Pp is a pixel pitch on the recording medium, and N is the number of non-ejection pixels in the non-ejection section.

5. The inkjet recording apparatus according to claim 1, wherein the non-ejection section with a predetermined length or more has a length that satisfies $$N>\{\gamma(Rd_n+Rd_{n+1})/2Pp\}-1$$

where $Rd_n$ is a diameter of a dot formed on the recording medium by an ink droplet ejected from the ink ejection port, $Rd_{n+1}$ is a diameter of a dot formed on the recording medium by a next ink droplet ejected, a coefficient γ (=0.7 to 1.0) is a ratio of an effective diameter to the dot diameters $Rd_n$ and $Rd_{n+1}$, Pp is a pixel pitch on the recording medium, and N is the number of non-ejection pixels in the non-ejection section.

6. The inkjet recording apparatus according to claim 1, wherein in one of the head modules, the overlapping region and a non-overlapping region extending from the overlapping region each include a plurality of the ink ejection ports, and throughout the overlapping region of the one head module from a boundary between the overlapping region and the non-overlapping region, the recording controller gradually changes a selection ratio for selecting ink ejection from the ink ejection ports of this head module.

7. The inkjet recording apparatus according to claim 6, wherein a second condition is that the ink ejection port has been selected using a threshold matrix based on a selection ratio gradient table defined within the overlapping region, and the selection ratio is changed by the recording controller switching from ink ejection from one ink ejection port to ink ejection from the other ink ejection port when the two conditions are satisfied.

8. The inkjet recording apparatus according to claim 7, wherein the selection ratio gradient table for the image data with a higher recording density has a steeper gradient.

9. An inkjet recording method comprising:

using a recorder having a line head, the line head including a plurality of head modules each having a plurality of ink ejection ports arranged in a line, the head modules being arranged in an arrangement direction of the ink ejection ports and overlapping in an overlapping region, the recorder ejecting ink through each of the ink ejection ports toward a recording medium;

using a mover that moves the recording medium and the line head relative to each other in a direction intersecting the arrangement direction of the ink ejection ports in the line head, and causes each pair of ink ejection ports of two adjacent head modules facing each other in the overlapping region to pass through a same place on the recording medium;

controlling ink ejection operations of the plurality of head modules on the recording medium in accordance with dot data that are based on image data, and causing, in the overlapping region, either of a pair of ink ejection ports of two adjacent head modules to eject ink to implement complementary ink ejection operations by the pair of ink ejection ports of the two head modules; and switching, in the overlapping region, from ink ejection from one of a pair of ink ejection ports to ink ejection from the other ink ejection port when at least one condition is satisfied, the one condition being that a non-ejection section has continued for a predetermined length or more in the dot data.

10. The inkjet recording method according to claim 9, wherein the ink thickens due to a phase change after being landed on the recording medium.

11. The inkjet recording method according to claim 10, wherein the recording medium is coated with a pretreatment material, and the ink undergoes the phase change by reacting with the pretreatment material.

12. The inkjet recording method according to claim 9, wherein the non-ejection section with a predetermined length or more has a length that satisfies $$N>(\gamma Rd/Pp)-1$$

where Rd is a maximum diameter of a dot formed on the recording medium by an ink droplet ejected from the ink ejection port, a coefficient γ (=0.7 to 1.0) is a ratio of an effective diameter to the maximum diameter Rd, Pp is a pixel pitch on the recording medium, and N is the number of non-ejection pixels in the non-ejection section.

13. The inkjet recording method according to claim 9, wherein the non-ejection section with a predetermined length or more has a length that satisfies $$N>\{\gamma(Rd_n+Rd_{n+1})/2Pp\}-1$$

where $Rd_n$ is a diameter of a dot formed on the recording medium by an ink droplet ejected from the ink ejection port, $Rd_{n+1}$ is a diameter of a dot formed on the recording medium by a next ink droplet ejected, a coefficient γ (=0.7 to 1.0) is a ratio of an effective diameter to the dot diameters $Rd_n$ and $Rd_{n+1}$, Pp is a pixel pitch on the recording medium, and N is the number of non-ejection pixels in the non-ejection section.

14. The inkjet recording method according to claim 9, wherein in one of the head modules, the overlapping region and a non-overlapping region extending from the overlapping region each include a plurality of the ink ejection ports, and throughout the overlapping region of the one head module from a boundary between the overlapping region and the non-overlapping region, a selection ratio for selecting ink ejection from the ink ejection ports of this head module is gradually changed, a second condition is that the ink ejection port has been selected using a threshold matrix based on a selection ratio gradient table defined within the overlapping region, and the selection ratio is changed by switching from ink ejection from one ink ejection port to ink ejection from the other ink ejection port when the two conditions are satisfied, and the selection ratio gradient table for the image data with a higher recording density has a steeper gradient.

15. A non-transitory recording medium storing a computer readable inkjet recording program, the program controlling an inkjet recording apparatus by being executed on a computer, the inkjet recording apparatus comprising:

a recorder having a line head, the line head including a plurality of head modules each having a plurality of ink ejection ports arranged in a line, the head modules being arranged in an arrangement direction of the ink ejection ports and overlapping in an overlapping region, the recorder ejecting ink through each of the ink ejection ports toward a recording medium; and a mover that moves the recording medium and the line head relative to each other in a direction intersecting the arrangement direction of the ink ejection ports in the line head, and causes each pair of ink ejection ports of two adjacent head modules facing each other in the overlapping region to pass through a same place on the recording medium, wherein the program causes the computer to perform:

controlling ink ejection operations of the plurality of head modules on the recording medium in accordance with dot data that are based on image data, and causing, in the overlapping region, either of a pair of ink ejection ports of two adjacent head modules to eject ink to implement complementary ink ejection operations by the pair of ink ejection ports of the two head modules; and switching, in the overlapping region, from ink ejection from one of a pair of ink ejection ports to ink ejection from the other ink ejection port when at least one condition is satisfied, the one condition being that a non-ejection section has continued for a predetermined length or more in the dot data.

16. The non-transitory recording medium storing a computer readable inkjet recording program according to claim 15, wherein the inkjet recording apparatus uses the ink that thickens due to a phase change after being landed on the recording medium.

17. The non-transitory recording medium storing a computer readable inkjet recording program according to claim 16, wherein the recording medium is coated with a pretreatment material, and the ink undergoes the phase change by reacting with the pretreatment material.

18. The non-transitory recording medium storing a computer readable inkjet recording program according to claim 15, wherein the non-ejection section with a predetermined length or more has a length that satisfies $$N>(\gamma Rd/Pp)-1$$

where Rd is a maximum diameter of a dot formed on the recording medium by an ink droplet ejected from the ink ejection port, a coefficient γ (=0.7 to 1.0) is a ratio of an effective diameter to the maximum diameter Rd, Pp is a pixel pitch on the recording medium, and N is the number of non-ejection pixels in the non-ejection section.

19. The non-transitory recording medium storing a computer readable inkjet recording program according to claim 15, wherein the non-ejection section with a predetermined length or more has a length that satisfies $$N>\{\gamma(Rd_n+Rd_{n+1})/2Pp\}-1$$

where $Rd_n$ is a diameter of a dot formed on the recording medium by an ink droplet ejected from the ink ejection port, $Rd_{n+1}$ is a diameter of a dot formed on the recording medium by a next ink droplet ejected, a coefficient γ (=0.7 to 1.0) is a ratio of an effective diameter to the dot diameters $Rd_n$ and $Rd_{n+1}$, Pp is a pixel pitch on the recording medium, and N is the number of non-ejection pixels in the non-ejection section.

20. The non-transitory recording medium storing a computer readable inkjet recording program according to claim 15, wherein in one of the head modules, the overlapping region and a non-overlapping region extending from the overlapping region each include a plurality of the ink ejection ports, and throughout the overlapping region of the one head module from a boundary between the overlapping region and the non-overlapping region, a selection ratio for selecting ink ejection from the ink ejection ports of this head module is gradually changed, a second condition is that the ink ejection port has been selected using a threshold matrix based on a selection ratio gradient table defined within the overlapping region and the selection ratio is changed by switching from ink ejection from one ink ejection port to ink ejection from the other ink ejection port when the two conditions are satisfied, and the selection ratio gradient table for the image data with a higher recording density has a steeper gradient.

* * * * *